US010220290B1

(12) United States Patent
Podolosky et al.

(10) Patent No.: US 10,220,290 B1
(45) Date of Patent: Mar. 5, 2019

(54) METHOD AND SYSTEM FOR COLLABORATIVE SCORING OF A SPORTING EVENT

(71) Applicant: ScoreStream, Inc., Solana Beach, CA (US)

(72) Inventors: David Podolosky, San Diego, CA (US); Joshua Stephens, San Diego, CA (US)

(73) Assignee: ScoreStream, Inc., Solano Beach, CA (US)

( * ) Notice: Subject to any disclaimer, the term of this patent is extended or adjusted under 35 U.S.C. 154(b) by 0 days.

(21) Appl. No.: 15/289,143

(22) Filed: Oct. 8, 2016

Related U.S. Application Data

(60) Provisional application No. 62/239,286, filed on Oct. 9, 2015.

(51) Int. Cl.
*A63B 71/06* (2006.01)

(52) U.S. Cl.
CPC ..... *A63B 71/0669* (2013.01)

(58) Field of Classification Search
None
See application file for complete search history.

(56) References Cited

U.S. PATENT DOCUMENTS

2014/0089960 A1* 3/2014 Farah ..... H04H 60/66 725/24

* cited by examiner

*Primary Examiner* — Dmitry Suhol
*Assistant Examiner* — Peter Iannuzzi
(74) *Attorney, Agent, or Firm* — Clause Eight IPS; Michael Catania

(57) ABSTRACT

A system and method for collaborative scoring of a real-time sporting event is disclosed herein. The system includes a verification server and sources of content for a specific sporting event. The verification server is configured to receive digital communications from the sources, analyze each of the digital communications to verify that each of the communications is for the specific sporting event, determine a real-time score for the specific sporting event based on a collaboration of verified content from the digital communications, and post the score for the specific real-time sporting event.

11 Claims, 14 Drawing Sheets

Unknown (UserId:120313, GameScoreId:622285)
BranchNote : User is now collaborating on master.
User Rank : rookie
Confidence Grade : 30
- User's trust level is low 0 7
Q1 (10010)
Hide Unknown (UserId:120313, GameScoreId:622499)
BranchNote : User continues to collaborate on master.
Hide Reason : Dupe score (622550) from a higher ranked user hid this score.
User Rank : rookie
Confidence Grade : 30
- User's trust level is low 0 13
Q1 (10010)
Hide Unknown (UserId:120313, GameScoreId:622528)
BranchNote : Score was branched then a future score (622550) matched and remerged this user into master.
User Rank : rookie
Confidence Grade : 26
- User's trust level is low
- Game score 622550, by user Manatee Football, remerged with this one.

0 14
Q1 (10010)
Hide

Manatee Football (UserId:81002, GameScoreId:622539)
BranchNote : Manatee Football's home score (13) is less than Unknown's home score (14) currently on master. Manatee Football is on master because they have a higher rank (allstar vs rookie)
User Rank : allstar
Confidence Grade : 85
- User's trust level is high
- Game score 622499, by user Unknown, matched this score.

0 13
Q1 (10010)
Hide

Unknown (UserId:120313, GameScoreId:622549)
BranchNote : User previously branched, continue to commit scores to branch.
Hide Reason : Same user, and nothing changed (segment, clock, score)
User Rank : rookie
Confidence Grade : 20
- User's trust level is low 0 14
Q1 (10010)
Hide Manatee Football (UserId:81002, GameScoreId:622550)
BranchNote : User continues to collaborate on master.
User Rank : allstar
Confidence Grade : 85
- User's trust level is high
- Game score 622528, by user Unknown, remerged with this one.

0 14
Q1 (10010)
Hide

Unknown (UserId:120313, GameScoreId:622695)
BranchNote : This was the highest gameSegmentId (10015) but later on Manatee Football rolled back the gameSegmentId to (10010) thus retroactively branching this gameScore. Branched because Unknown has a lower rank (rookie vs allstar)
User Rank : rookie
Confidence Grade : 20
- User's trust level is low 0 14
End Q1 (10015)
Hide

FIG. 7

Parse Test at the half girls soccer class d #1 richmond up 1-0 over #3 buckfield #mesports #5q http://t.co/svmqplo1sg Test Best Match / Parse grade 95 at the half girls soccer class d #1 richmond up 1-0 over #3 buckfield #mesports #5q http://t.co/svmqplo1sg Parse Analysis Matched Keyword Matched Meta Matched Schema Subscring Match (140ch)

First Team Match Results

Richmond High School

Second Team Match Results

Buckfield High School

Parse Grade Info

FIG. 12

METHOD AND SYSTEM FOR COLLABORATIVE SCORING OF A SPORTING EVENT

CROSS REFERENCE TO RELATED APPLICATION

The Present Application claims priority to U.S. Provisional Patent Application No. 62/239,286, filed on Oct. 9, 2015, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to a method and system for collaborative scoring for a real-time sporting event.

Description of the Related Art

The public wants real-time information for an event. However, this real-time information needs to be accurate. Thus, there is a need for obtaining communications for a real-time event, verifying the information and producing a collaborative result.

General definitions for terms utilized in the pertinent art are set forth below.

APP is a software application for a mobile phone such as a smart phone.

Application Programming Interface (API) is a collection of computer software code, usually a set of class definitions, that can perform a set of related complex tasks, but has a limited set of controls that may be manipulated by other software-code entities. The set of controls is deliberately limited for the sake of clarity and ease of use, so that programmers do not have to work with the detail contained within the given API itself.

Code Division Multiple Access ("CDMA") is a spread spectrum communication system used in second generation and third generation cellular networks, and is described in U.S. Pat. No. 4,901,307.

FTP or File Transfer Protocol is a protocol for moving files over the Internet from one computer to another.

Global Positioning System (GPS) is a satellite based positioning system.

GSM, Global System for Mobile Communications is a second generation digital cellular network.

Hypertext Transfer Protocol ("HTTP") is a set of conventions for controlling the transfer of information via the Internet from a web server computer to a client computer, and also from a client computer to a web server, and Hypertext Transfer Protocol Secure ("HTTPS") is a communications protocol for secure communication via a network from a web server computer to a client computer, and also from a client computer to a web server by at a minimum verifying the authenticity of a web site.

Internet is the worldwide, decentralized totality of server computers and data-transmission paths which can supply information to a connected and browser-equipped client computer, and can receive and forward information entered from the client computer.

SSID (Service Set Identifier) is a 1 to 32 byte string that uniquely names a wireless local area network.

Transfer Control Protocol/Internet Protocol ("TCP/IP") is a protocol for moving files over the Internet.

Tweet is a communication (140 characters) using the online social networking service operated by Twitter, Inc. at Twitter.com.

URL or Uniform Resource Locator is an address on the World Wide Web.

User Interface or UI is the junction between a user and a computer program. An interface is a set of commands or menus through which a user communicates with a program. A command driven interface is one in which the user enter commands. A menu-driven interface is one in which the user selects command choices from various menus displayed on the screen.

Web-Browser is a complex software program, resident in a client computer, that is capable of loading and displaying text and images and exhibiting behaviors as encoded in HTML (HyperText Markup Language) from the Internet, and also from the client computer's memory. Major browsers include MICROSOFT INTERNET EXPLORER, NETSCAPE, APPLE SAFARI, MOZILLA FIREFOX, and OPERA.

Web-Server is a computer able to simultaneously manage many Internet information-exchange processes at the same time. Normally, server computers are more powerful than client computers, and are administratively and/or geographically centralized. An interactive-form information-collection process generally is controlled from a server computer, to which the sponsor of the process has access.

Wireless Application Protocol ("WAP") is an open, global specification that empowers users with mobile wireless communication devices (such as mobile phones) to easily access data and to interact with Websites over the Internet through such mobile wireless communication device. WAP works with most wireless communication networks such as CDPD, CDMA, GSM, PDC, PHS, TDMA, FLEX, reflex, iDEN, TETRA, DECT, DataTAC, Mobitex and GRPS. WAP can be built on most operating systems including PalmOS, WINDOWS, CE, FLEXOS, OS/9, JavaOS and others.

WAP Push is defined as an encoded WAP content message delivered (pushed) to a mobile communication device which includes a link to a WAP address.

BRIEF SUMMARY OF THE INVENTION

One aspect of the present invention is a method for collaborative scoring of a sporting event. The method includes receiving a plurality of digital communications at a verification server. Each of the plurality of digital communications comprising content for a specific real-time sporting event. The method also includes analyzing each of the plurality of digital communications at the verification server to verify the accuracy of the content for the specific real-time sporting event based on a plurality of factors. The method also includes determining the real-time score for the specific real-time sporting event based on a collaboration of verified content from the plurality of digital communications. The method also includes posting the real-time score for the specific real-time sporting event.

Another aspect of the present invention is a method for allowing multiple users or sources to collaborate on real-time scoring for a specific real-time sporting event. The method includes receiving a plurality of communications from a plurality of sources at a verification server. Each of the plurality of communications comprises content for a specific real-time sporting event. The method also includes analyzing each of the plurality of communications at the verification server to verify that each of the plurality of communications is for the specific real-time sporting event. The method also includes determining the real-time score for the specific real-time sporting event. The method also includes posting the real-time score for the specific real-time sporting event.

Yet another aspect of the present invention is a system for allowing multiple users or sources to collaborate on real-time scoring for a specific real-time sporting event. The system includes a verification server, and sources of content for a specific real-time sporting event. The verification server is configured to receive a plurality of communications from the plurality of sources. Each of the plurality of communications comprising content for the specific real-time sporting event. The verification server is configured to analyze each of the plurality of communications to verify that each of the plurality of communications is for the specific real-time sporting event. The verification server is configured to determine the real-time score for the specific real-time sporting event. The verification server is configured to post the real-time score for the specific real-time sporting event.

Yet another aspect of the present invention is a method for collaborative scoring of a specific real-time sporting event with verified content. The method includes receiving a plurality of communications from a plurality of sources at a verification server. Each of the plurality of communications comprising content for a specific real-time sporting event. The method also includes determining if each of the plurality of communications comprises content related to the specific real-time sporting event. The method also includes determining an origination location of each of the plurality of communications and a distance of the origination location from the geographical location of the specific real-time sporting event. The method also includes determining a reputation of the originator of each of the plurality of communications. The method also includes determining a transmission time period for each of the plurality of communications. The method also includes generating a confidence level for each of the plurality of digital communications based on at least one of a history of previous digital communications, an accuracy of previous digital communications, and a contribution type of previous digital communications. The method also includes determining the real-time score for the specific real-time sporting event based on a collaboration of verified content from the plurality of digital communications. The method also includes posting the real-time score for the specific real-time sporting event.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 7 is an illustration of multiple sources for collaborative scoring.

FIG. 12 is an illustration of tweet parser analysis.

DETAILED DESCRIPTION OF THE INVENTION

A preferred embodiment of the present invention is a method and system for collaborative scoring of a real-time sporting event.

In a specific embodiment, the present invention uses crowd sourcing to allow anyone to provide scores and users work together to provide a real-time score for a sporting event. Fans, coaches, parents, students, and media companies are all examples of users who make up a "crowd" and work together. The present invention uses powerful tools and algorithms built around verifying score information from users. Power users and good users out rank lesser experienced users when a conflict over score arises. Troublemakers are given blackball status rendering them effectively null throughout the system.

Figure 1:
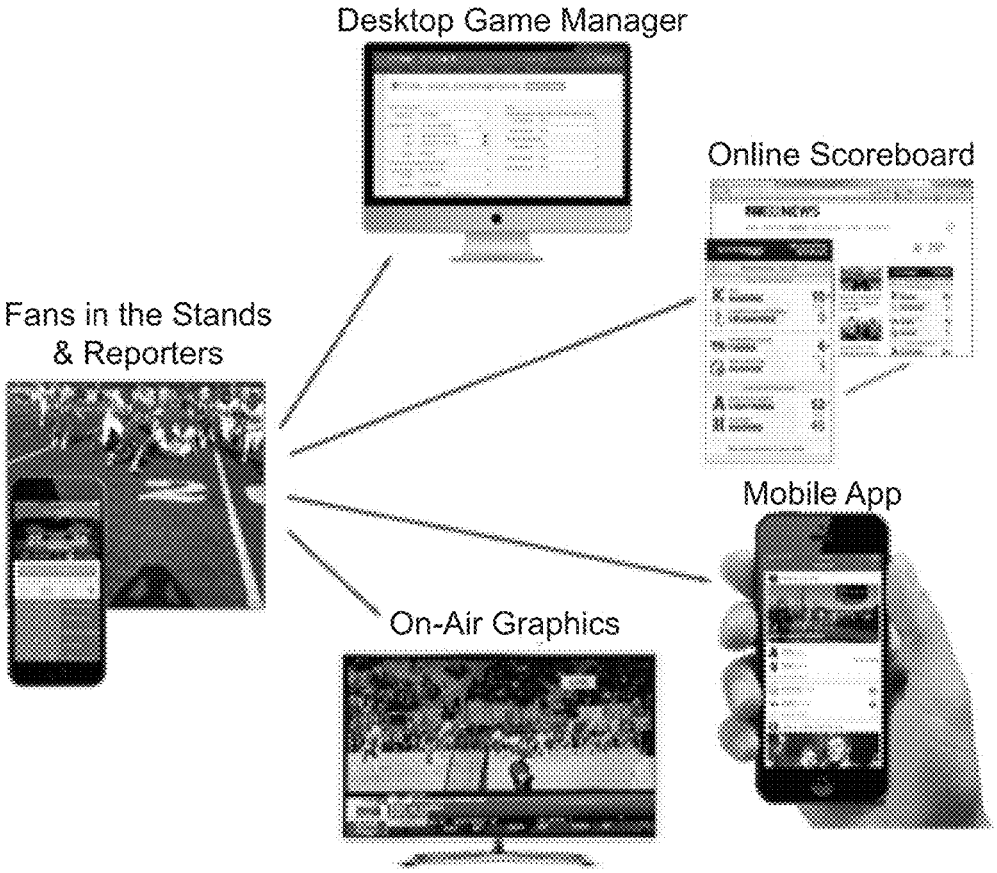
FIG. 1 is an illustration of system for collaborative scoring.
Figure 2:
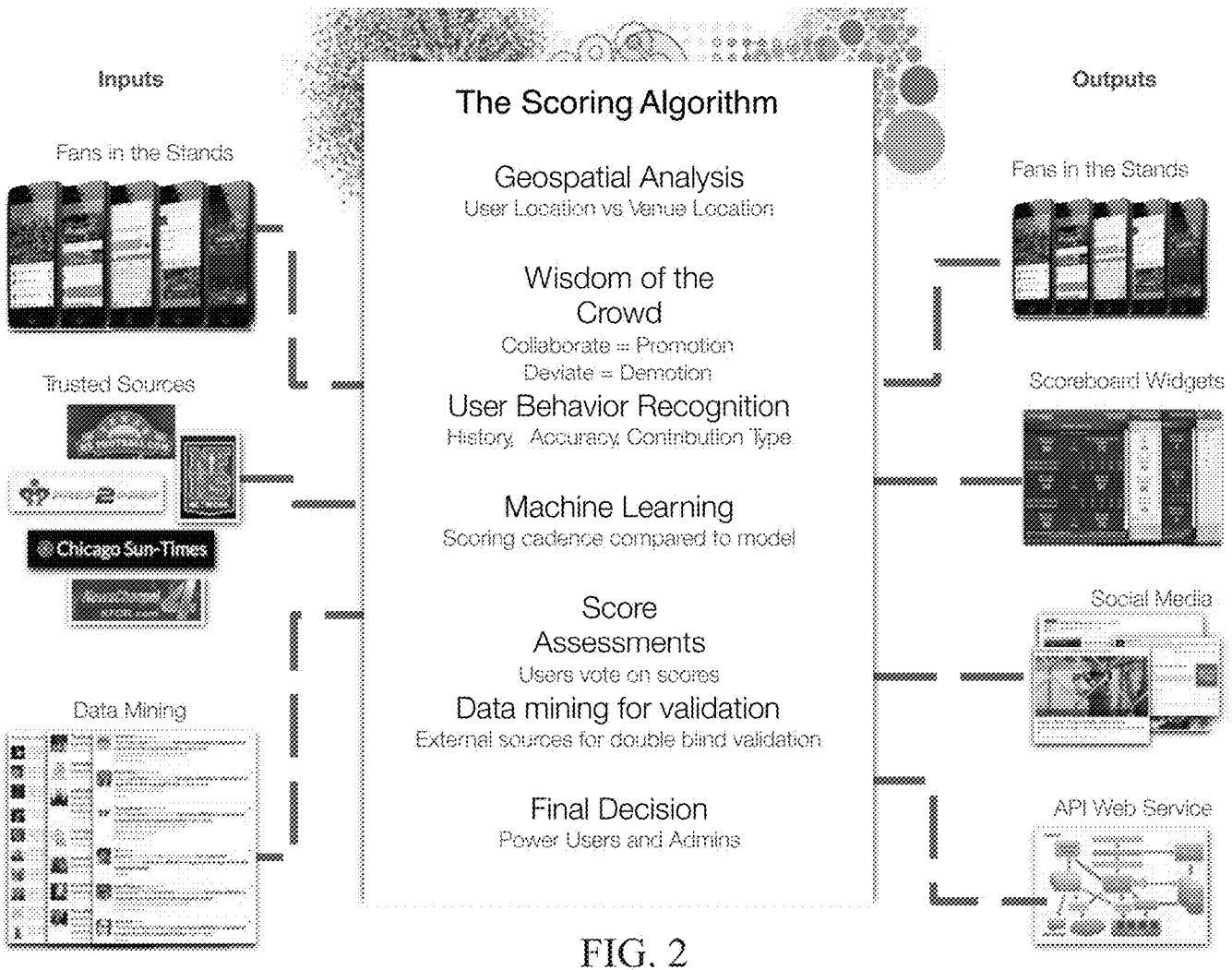
FIG. 2 is a block diagram of a system for collaborative scoring.
Figure 5:
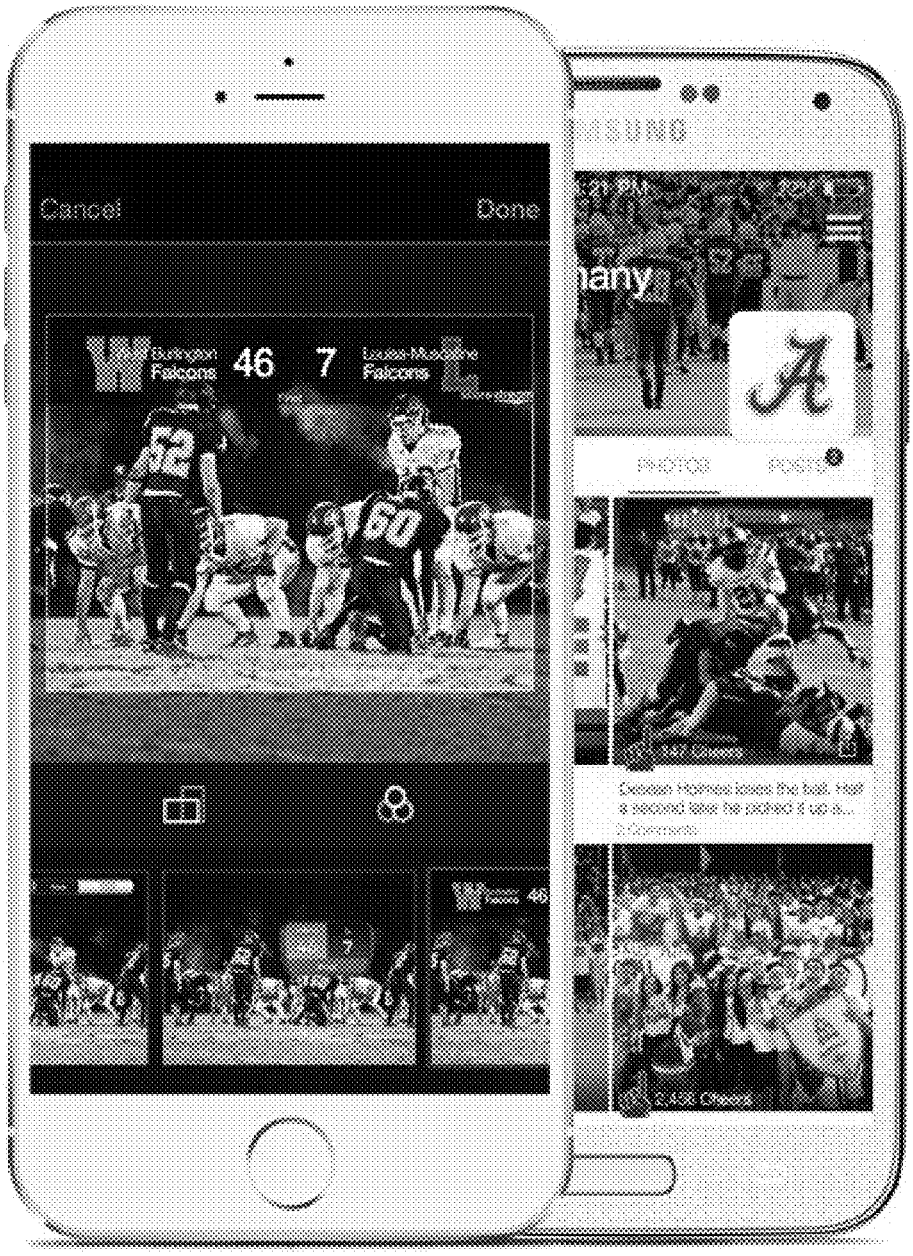
FIG. 5 is an illustration of a mobile phone with scores from high school football games displayed on the screen.
Figure 6:
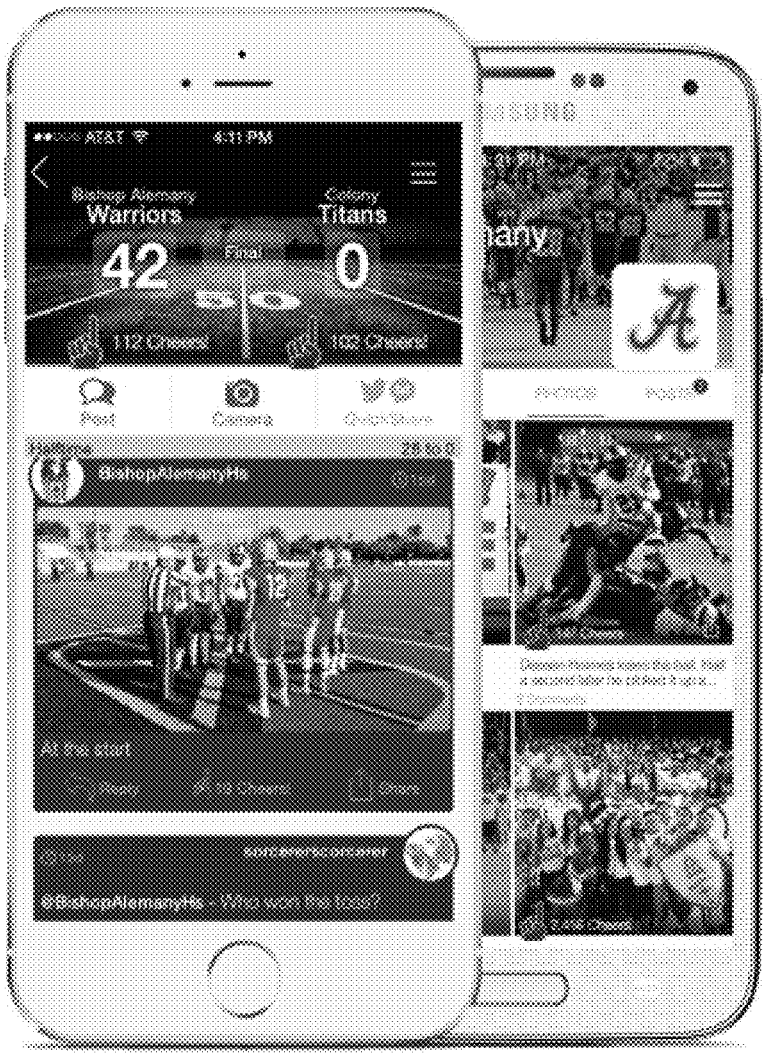
FIG. 6 is an illustration of a mobile phone with scores from high school football games displayed on the screen.

FIG. 1 illustrates various sources for collaborative scoring of a real-time sporting event. FIG. 2 illustrates an algorithm for generating a real-time score for the specific real-time sporting event. The inputs are digital communications from multiple sources such as social media posts, data mining, online news postings, and the like. The algorithm uses geospatial analysis, wisdom of the crowd, user behavior, machine learning, score assessments, data mining for validation and a final decision from power users and administrators if a conflict arises. The output, the real-time scoring results, sent to mobile applications on mobile devices, scoring widgets, social media and an API web service. FIG. 5 is an illustration of a mobile phone with scores from high school football games displayed on the screen. FIG. 6 is an illustration of a mobile phone with scores from high school football games displayed on the screen.

One embodiment of the present invention is a method for analyzing and extracting event information and other data from natural language text. The method includes receiving a plurality of digital communications at a verification server. Each of the plurality of digital communications comprising content for a specific event. The method also includes analyzing each of the plurality of digital communications at the verification server to determine a result for the specific event. The method also includes determining the result for the specific event. The method also includes posting the result for the specific event.

Analyzing each of the plurality of digital communications preferably includes determining if each of the plurality of digital communications comprises content related to the specific event, determining a reputation of the originator of each of the plurality of digital communications, and determining a transmission time period for each of the plurality of digital communications. Analyzing each of the plurality of digital communications further comprises determining an origination location of each of the plurality of digital communications and a distance of the origination location from the geographical location of the specific event.

The method preferably further includes generating a confidence level for each of the plurality of digital communications.

Each of the plurality of digital communications is preferably a tweet and/or post on a social media site. The content of each of the plurality of digital communications comprises at least one of a segment, which teams are playing, a result, an event, a gender and a level of participation. Each of the plurality of digital communications is preferably a communication from a mobile communication device.

Another embodiment of present invention is a system for analyzing and extracting event information and other data from natural language text. The system includes a verification server and sources of content for a specific event. The verification server is configured to receive a plurality of communications from the plurality of sources. Each of the plurality of communications comprising content for the specific event. The verification server is configured to analyze each of the plurality of communications to verify that each of the plurality of communications is for the specific event. The verification server is configured to determine a real-time result for the specific event. The verification server is configured to post the result for the specific event.

The verification server is preferably configured to determine if each of the plurality of communications comprises content related to the specific event, determine a reputation of the originator of each of the plurality of communications, and determine a transmission time period for each of the plurality of communications. The verification server is also preferably configured determine an origination location of each of the plurality of communications and a distance of the origination location from the geographical location of the specific event. The verification server is also preferably configured generate a confidence level for each of the plurality of communications.

Another more specific embodiment of the present invention is a method for analyzing and extracting scoring information and other game data from natural language text. The method includes receiving a plurality of digital communications at a verification server. Each of the plurality of digital communications comprises content for a specific real-time sporting event. The method also includes analyzing each of the plurality of digital communications at the verification server to determine a real-time score for the specific real-time sporting event. The method also includes determining the real-time score for the specific real-time sporting event. The method also includes posting the real-time score for the specific real-time sporting event.

Analyzing each of the plurality of digital communications preferably includes determining if each of the plurality of digital communications comprises content related to the specific real-time sporting event, determining a reputation of the originator of each of the plurality of digital communications, and determining a transmission time period for each of the plurality of digital communications.

The real-time score for the real-time sporting event is preferably posted at a web site.

The specific real-time sporting event is preferably one of a high school football game, a high school basketball game, a high school baseball game, a high school soccer game, a college football game, a college basketball game, a college baseball game, a college soccer game, a professional football game, a professional basketball game, a professional baseball game, a professional soccer game, a semi-professional football game, a youth football game, a softball game, a hockey game, a lacrosse game, a water polo game, a rugby match, a volleyball match, and a field hockey game.

Each of the plurality of digital communications is preferably a social media message such as a tweet from a TWITTER account. Other social media messages include images from INSTAGRAM, SNAPCHAT messages, PINTEREST messages, FACEBOOK messaging messages, and the like. The content of each of the plurality of digital communications preferably comprises which teams are playing, segment, scores, a sport, a gender and a level of play. Also, the content preferably contains meta-data such as GPS coordinates for the message, or other location information.

Analyzing each of the plurality of digital communications further comprises determining an origination location of each of the plurality of digital communications and a distance of the origination location from the geographical location of the specific real-time sporting event.

The method also preferably includes generating a confidence level for each of the plurality of digital communications.

Each of the plurality of digital communications is alternatively a communication from a mobile application resident on a mobile communication device. Each of the plurality of digital communications is alternatively a post on a social media site.

Another more specific embodiment of the present invention is a method for allowing multiple users or sources to collaborate on real-time scoring for a specific real-time sporting event. The method includes receiving a plurality of communications from a plurality of sources at a verification server. Each of the plurality of communications comprises content for a specific real-time sporting event. The method also includes analyzing each of the plurality of communications at the verification server to verify that each of the plurality of communications is for the specific real-time sporting event. The method also includes determining the real-time score for the specific real-time sporting event. The method also includes posting the real-time score for the specific real-time sporting event.

Yet another aspect of the present invention is a system for allowing multiple users or sources to collaborate on real-time scoring for a specific real-time sporting event. The system includes a verification server, and sources of content for a specific real-time sporting event. The verification server is configured to receive a plurality of communications from the plurality of sources. Each of the plurality of communications comprising content for the specific real-time sporting event. The verification server is configured to analyze each of the plurality of communications to verify that each of the plurality of communications is for the specific real-time sporting event. The verification server is configured to determine the real-time score for the specific real-time sporting event. The verification server is configured to post the real-time score for the specific real-time sporting event.

The mobile devices utilized with the present invention preferably include mobile phones, smartphones, tablet computers, PDAs and the like. Examples of smartphones and the device vendors include the IPHONE® smartphone from Apple, Inc., the DROID® smartphone from Motorola Mobility Inc., GALAXY S® smartphones from Samsung Electronics Co., Ltd., and many more. Examples of tablet computing devices include the IPAD® tablet from Apple Inc., and the XOOM™ tablet from Motorola Mobility Inc.

A mobile communication service provider (aka phone carrier) of the customer such as VERIZON, AT&T, SPRINT, T-MOBILE, and the like mobile communication service providers, provide the communication network for communication to the mobile communication device of the end user.

Wireless standards include 802.11a, 802.11b, 802.11g, AX.25, 3G, CDPD, CDMA, GSM, GPRS, radio, microwave, laser, Bluetooth, 802.15, 802.16, and IrDA.

Figure 4:
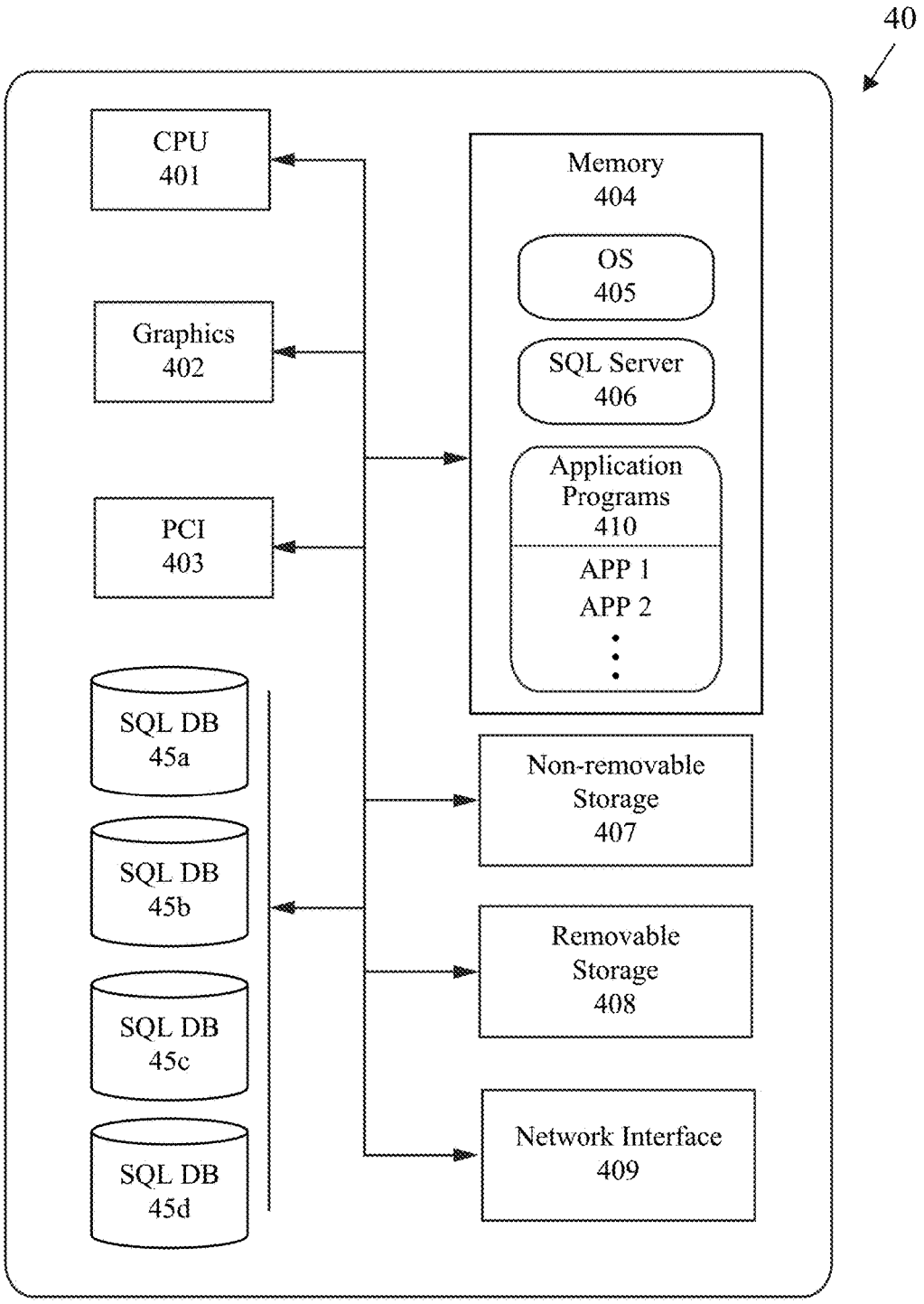
FIG. 4 is a block diagram of components of a preferred embodiment of a data server.

FIG. 4 shows components of a server 40. Components of the server 40 includes a CPU component 401, a graphics component 402, PCI/PCI Express 403, a memory 404, a non-removable storage 407, a removable storage 408, a network interface 409, including one or more connections to a fixed network, and SQL databases 45*a*-45*d*. Included in the memory 404, is an operating system 405, a SQL server 406 or other database engine, and application programs/software 410. The server also includes at least one computer program configured to receive data uploads and store the data uploads in the SQL database. Alternatively, the SQL server can be installed in a separate server from the venue server.

Communication protocols utilized with the present invention may preferably include but are not limited to XML, HTTP, TCP/IP, Serial, UDP, FTP, Web Services, WAP, SMTP, SMPP, DTS, Stored Procedures, Import/Export, Global Positioning Triangulation, IM, SMS, MMS, GPRS and Flash. The databases used with the system preferably include but are not limited to MSSQL, Access, MySQL, Progress, Oracle, DB2, Open Source DBs and others. Operating system used with the system preferably include Microsoft 2010, XP, Vista, 200o Server, 2003 Server, 2008 Server, Windows Mobile, Linux, Android, Unix, I series, AS 400 and Apple OS.

The underlying protocol at a verification server, may be an Internet Protocol Suite (Transfer Control Protocol/Internet Protocol ("TCP/IP")), and the transmission protocol to receive a file is preferably a file transfer protocol ("FTP"), Hypertext Transfer Protocol ("HTTP"), Secure Hypertext Transfer Protocol ("HTTPS") or other similar protocols. The transmission protocol ranges from SIP to MGCP to FTP and beyond. The protocol at the server is preferably HTTPS.

Figure 3:
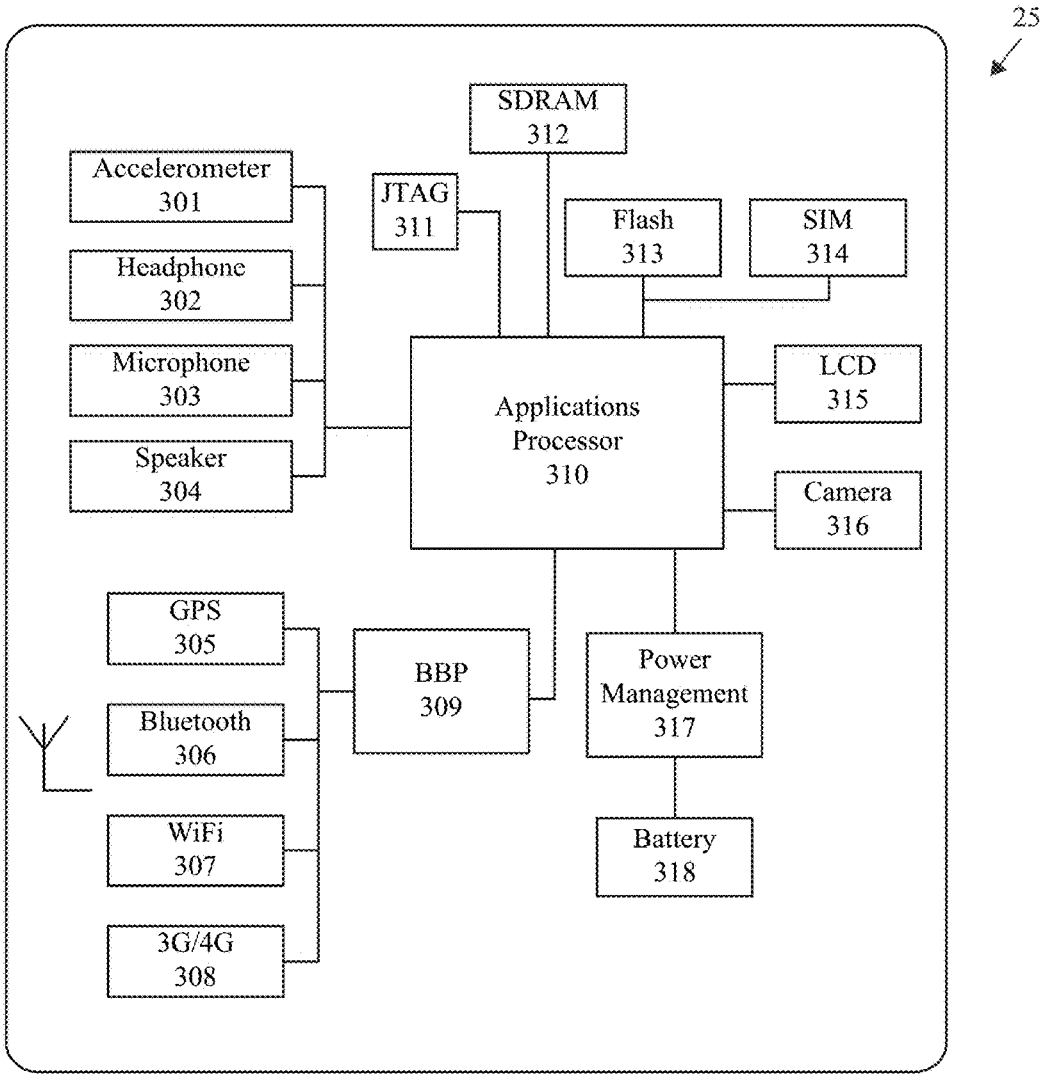
FIG. 3 is a block diagram of components of a preferred embodiment of a mobile communication device.

As shown in FIG. 3, a typical mobile communication device 25 includes an accelerometer 301, a headphone jack 302, a microphone jack 303, a speaker 304, a GPS chipset 305, a Bluetooth component 306, a Wi-Fi component 307, a 3G/4G component 308, a Baseband Processor (for radio control) 309, an applications (or main) processor 310, a JTAG (debugger) 311, a SDRAM memory 312, a Flash memory 313, SIM card 314, LCD display 315, a camera 316, a power management circuit 317 and a battery or power source 318.

FIG. 7 illustrates collaborative digital communications for a specific sporting event. The collaboration of digital communications shows an identification for the source of the digital communication, a user rank, a confidence grade (whether high or low), the content (in this example the score of the football game), the date and time of the communication, and miscellaneous notes. Metadata in each of the digital communications preferably also includes a geolocation (most preferably GPS coordinates) of the digital communication.

Figure 8:
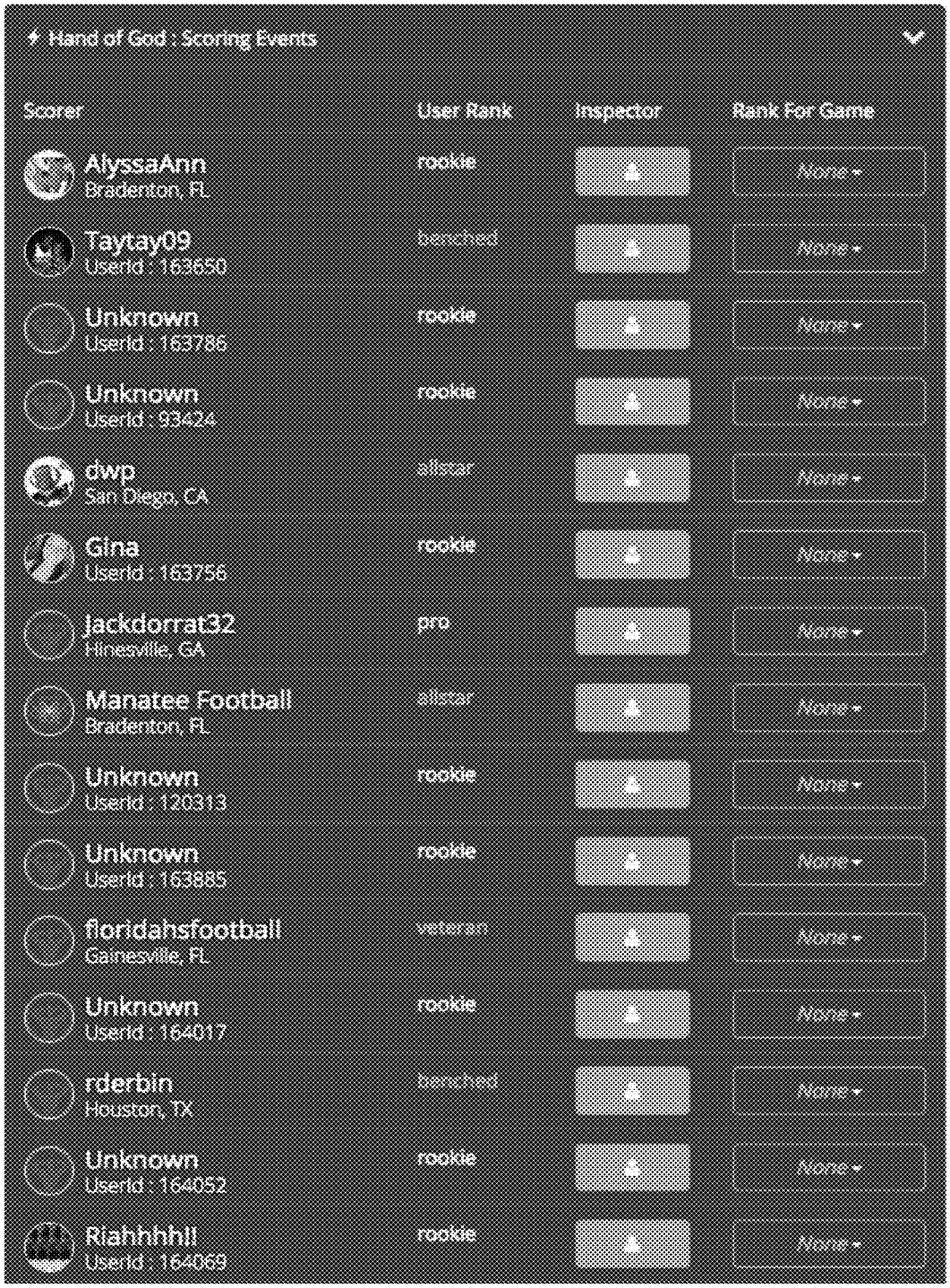
FIG. 8 is an illustration of collaborative scoring with the ranking of sources of digital communications.

FIG. 8 illustrates final decision user rankings for collaborative digital communications for a specific sporting event. The collaboration of digital communications shows an identification for the source of the digital communication, a user rank, an inspector, and a rank for the specific sporting event.

Figure 9:
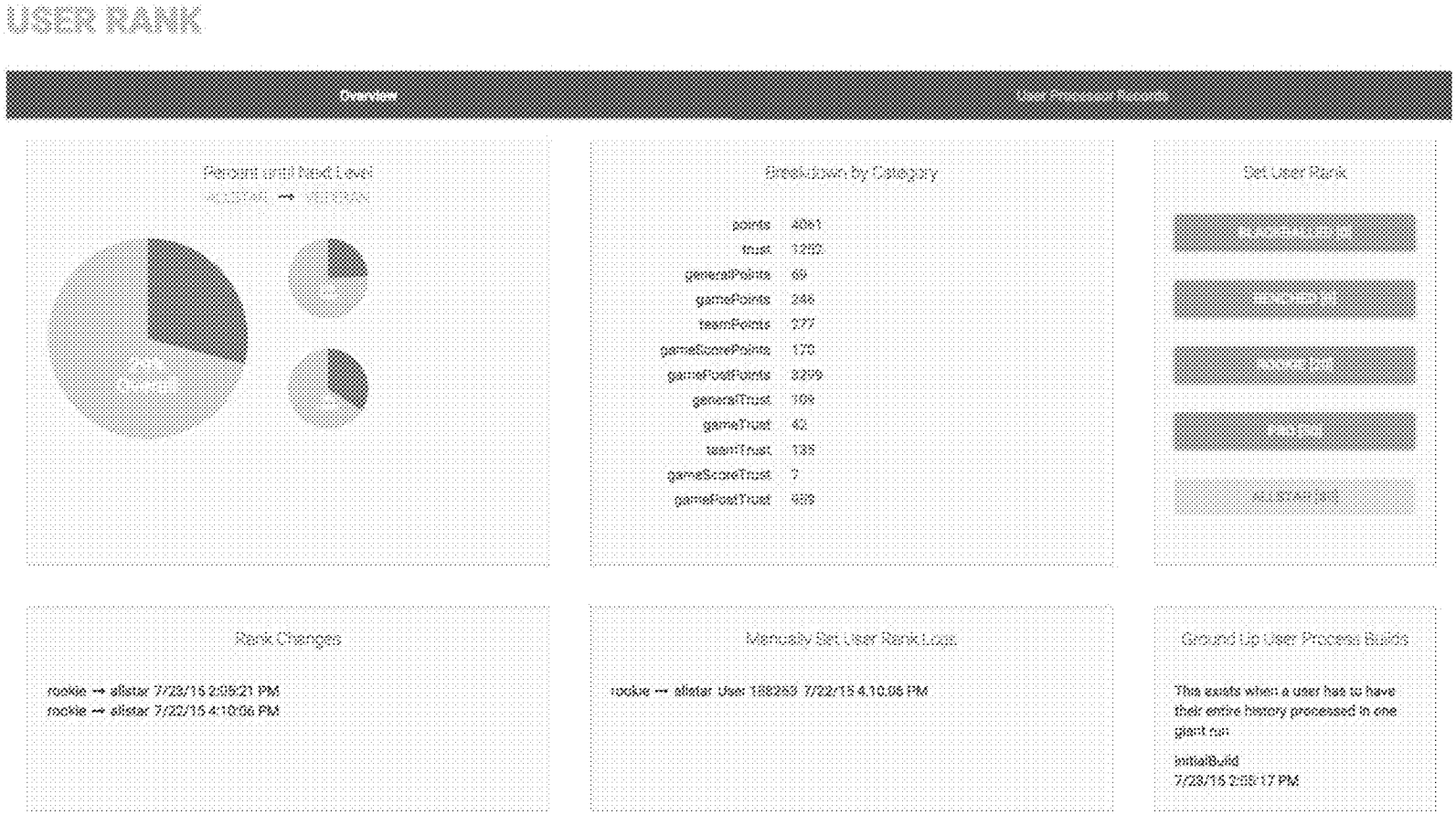
FIG. 9 is an illustration of a user rank for a participant that provides digital communications for an event.

FIG. 9 illustrates a user rank for an individual source. The user ranking indicates changes, factors in generating a confidence level for digital communications from this source, and an overall ranking.

Figure 10:
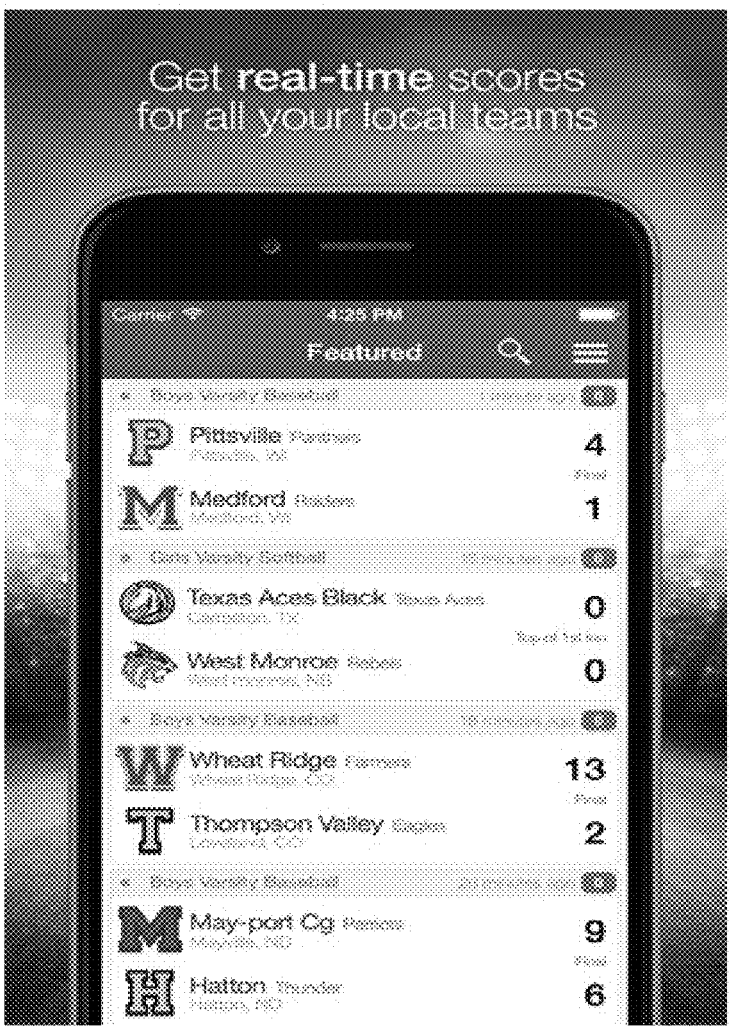
FIG. 10 is an illustration of a mobile phone with scores from high school football games displayed on the screen.

FIG. 10 illustrates a mobile application 150 on a display of a mobile phone 25. The mobile application displays various real-time results (scores) for on-going sporting events.

Figure 11:
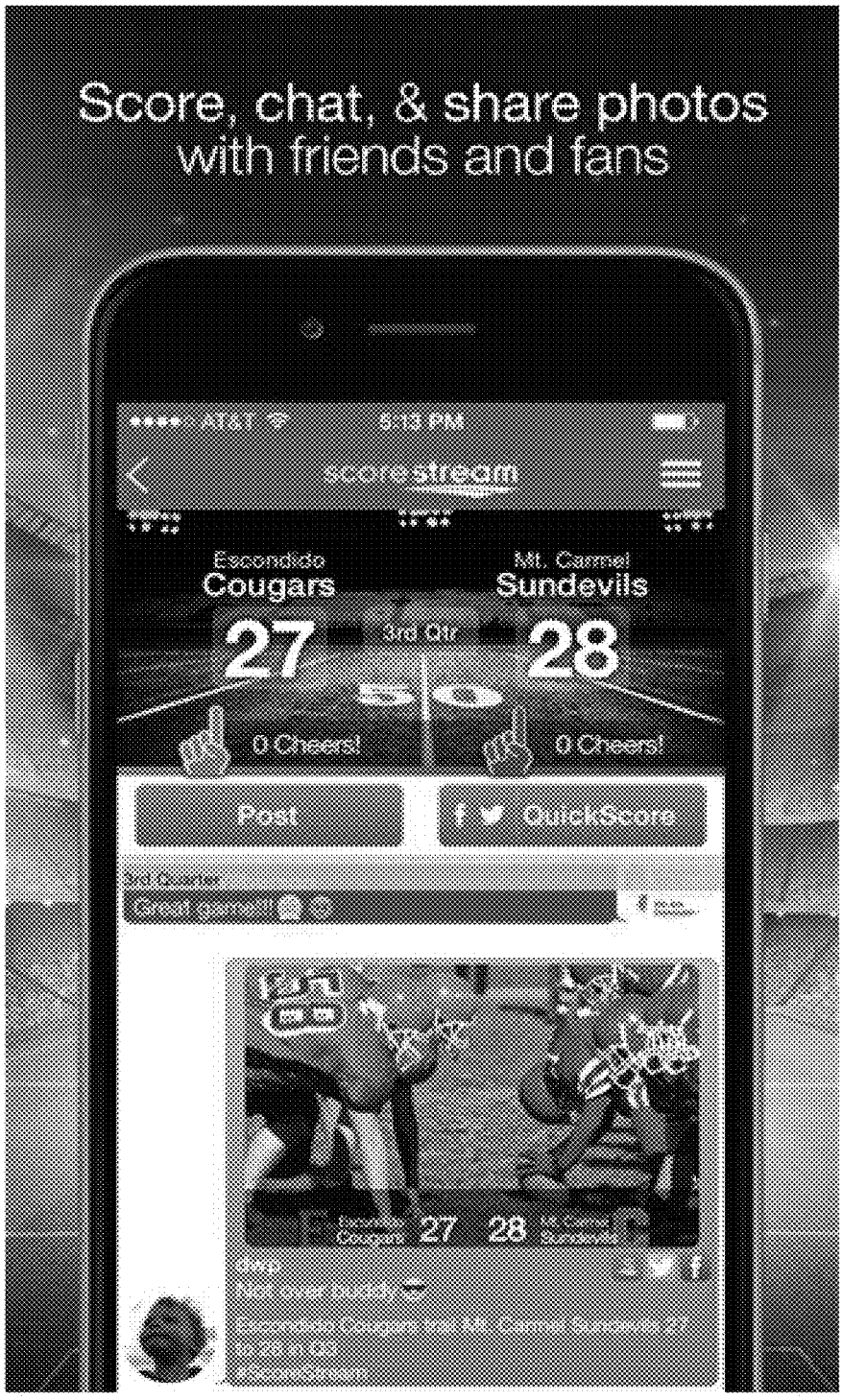
FIG. 11 is an illustration of a mobile phone with a score of a local football game and a tweet communication related to the football game.

FIG. 11 illustrates a mobile application 150 on a display of a mobile phone 25. The mobile application displays a real-time score for on-going sporting event, and available content from a digital communication for the specific sporting event.

FIG. 12 illustrates a parsing of a digital communication (a tweet) from a source (a TWITTER account). The parsing provides a parse grade for the digital communication, and shows the analysis for the parsing.

Figure 13:
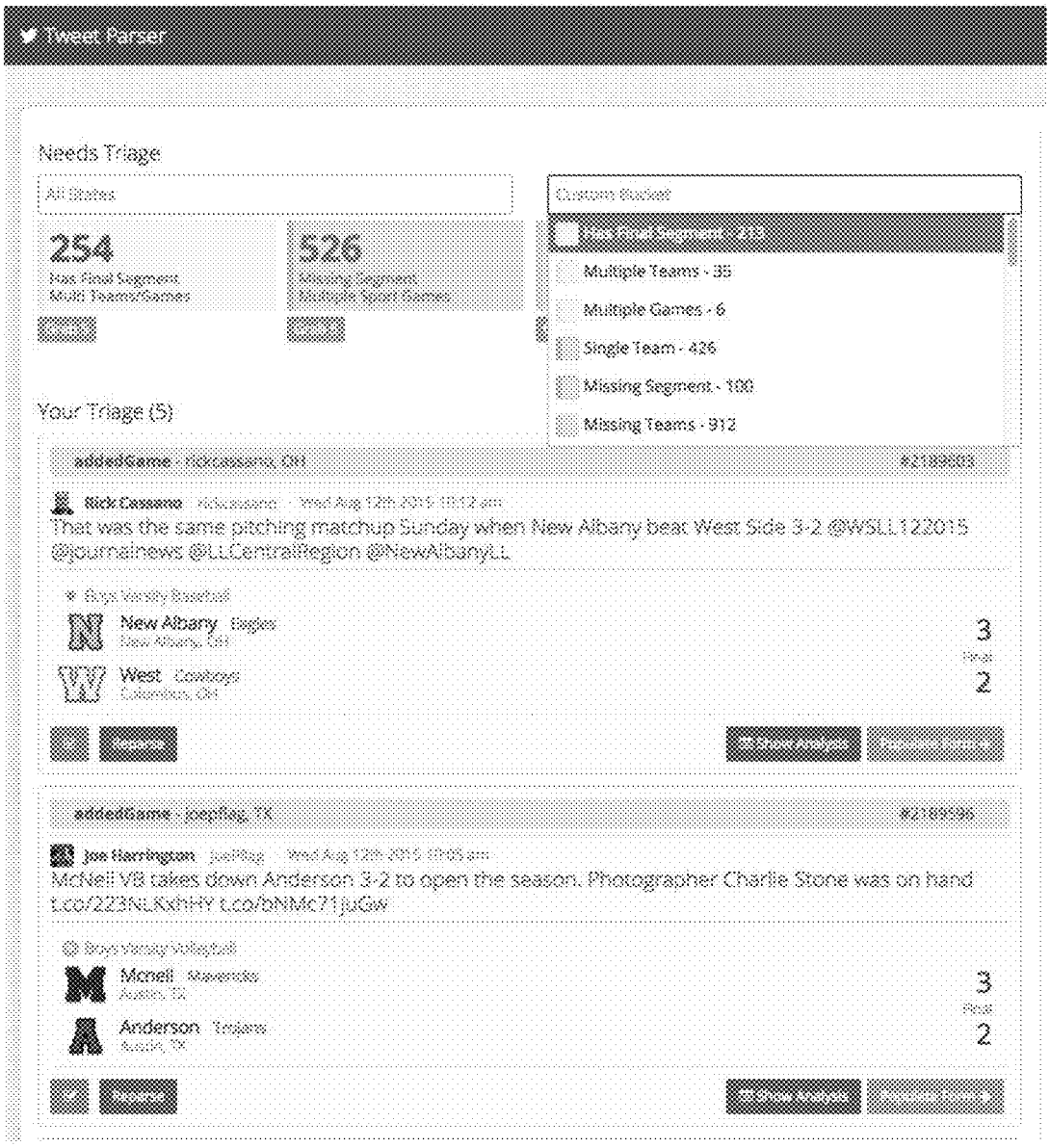
FIG. 13 is an illustration of tweet parser analysis.

FIG. 13 illustrates a parsing analysis of a digital communication (a tweet) from a source (a TWITTER account).

Figure 14:
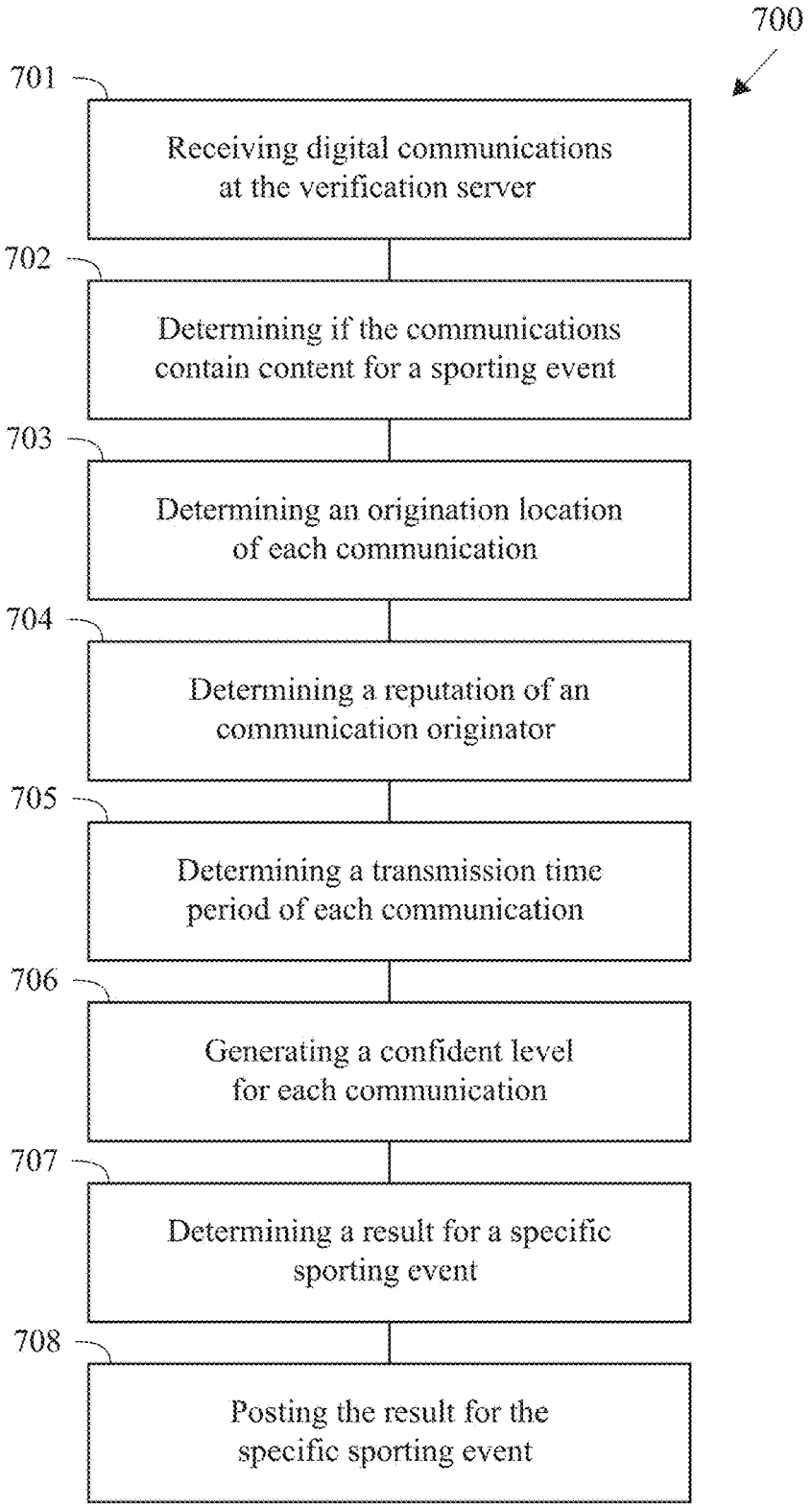
FIG. 14 is a flow chart of a method for collaborative scoring.

FIG. 14 is a flowchart of a method 700 for collaborative scoring of a specific real-time sporting event with verified content. At block 701, multiple communications from multiple sources are received at a verification server. Each of the communications comprises content for a specific real-time sporting event. At block 702, the verification server determines if each of the plurality of communications comprises content related to the specific real-time sporting event. The method also includes determining a origination location of each of the plurality of communications and a distance of the origination location from the geographical location of the specific real-time sporting event. The method also includes determining a reputation of the originator of each of the plurality of communications. The method also includes determining a transmission time period for each of the plurality of communications. The method also includes generating a confidence level for each of the plurality of digital communications based on at least one of a history of previous digital communications, an accuracy of previous digital communications, and a contribution type of previous digital communications. The method also includes determining the real-time score for the specific real-time sporting event based on a collaboration of verified content from the plurality of digital communications. The method also includes posting the real-time score for the specific real-time sporting event.

The method also performs a statistical analysis of the score to determine a confidence level for the score, wherein the statistical analysis reviews all scores of the game, the type of sport, a segment, and a duration into the game, and the statistical analysis is based on a plurality of previous statistics computed from a plurality of past games.

The method, at the verification server, also subjects each score to a machine learning model generated from a plurality of past confirmed scores, wherein a predicted result for each score is generated from a machine learning algorithm to generate a confidence level for each score.

The method also presents all of the scoring for a game to the users for that game and allowing the users to vote on the accuracy of the entered score to generate a plurality of score assessments, wherein after each score assessment of the plurality of score assessment is generated, user information is utilized to determine a confidence level of an entered score, wherein user information comprises at least one of a user location, a user scoring history and a user level.

Analyzing each of the plurality of digital communications further comprises determining an origination location of each of the plurality of digital communications and a distance of the origination location from the geographical location of the specific real-time sporting event.

The method also generates a confidence level for each of the plurality of digital communications based on at least one of a history of previous digital communications, an accuracy of previous digital communications, and a contribution type of previous digital communications.

The content of each of the digital communications comprises at least one of which teams are playing, segment, scores, a game clock, game statistics, player statistics, a sport, a gender and a level of play.

The method also preferably includes performing a statistical analysis of the score to determine a confidence level for the score, wherein the statistical analysis reviews all scores of the game, the type of sport, a segment, and a duration into the game, and the statistical analysis is based on a plurality of previous statistics computed from a plurality of past games.

The method also includes at the verification server subjecting each score to a machine learning model generated from a plurality of past confirmed scores, wherein a predicted result for each score is generated from a machine learning algorithm to generate a confidence level for each score.

The method also includes presenting all of the scoring for a game to the users for that game and allowing the users to vote on the accuracy of the entered score to generate a plurality of score assessments, wherein after each score assessment of the plurality of score assessment is generated, user information is utilized to determine a confidence level of an entered score, wherein user information comprises at least one of a user location, a user scoring history and a user level.

For location determination, in one embodiment, a native application 150 requests a location update. The mobile communication device 25 receives GPS coordinates from a GPS system through a GPS component 305 of the mobile communication device 25. The mobile communication device 25 includes the geographical coordinates and a time period of the digital communication for the specific real-time event. The mobile communication device transmits the digital communication with the content, the geographical location and time coordinates to the server 40 over a network (cellular, WiFi or other). The digital communication with the content (image or other) is transmitted with a geo-location marker and a time stamp preferably from a clock mechanism of the mobile device 25.

Also for location verification of a digital communication from a mobile device 25 related to a specific sporting event, the verification server 40 queries a mobile data network on which the mobile communication device 25 operates for the geographical location of the mobile communication device 25. The mobile data network, through the network location service, utilizes triangulation, nearest cell tower data, or the like to provide an approximate geographical location of the mobile communication device 25. The mobile data network transmits the approximate geographical location of the mobile device 25 to verification server 40. The verification server 40 then determines if the geographical location provided by the mobile communication device 25 is within a predefined boundary of the approximate geographical location of the mobile communication device 25 provided by the mobile data network. Confirmation is made if the verification server 40 determines that the geographical locations are within the predefined boundary.

The following is code snippet utilized in the present invention.

```
exports.influencerScores={
awayScoreGrosslyAbove95thPercentile: −5,
homeScoreGrosslyAbove95thPercentile: −5,
combinedScoreGrosslyAbove95thPercentile: −5,
awayScoreAbove95thPercentile: −4,
homeScoreAbove95thPercentile: −4,
combinedScoreAbove95thPercentile: −4,
scoreGrosslyAboveSportThreshold: −5,
scoreAboveSportThreshold: −4,
combinedScoreBelow5thPercentile: −2,
scoringBehaviorIsVeryBad: −5,
scoringBehaviorIsBad: −4,
scoringBehaviorIsUnclear: −2,
scoringBehaviorIsGood: 2,
scoringBehaviorIsVeryGood: 5,
gameScoreLocationIsFarDistanceToGame: −1,
gameScoreLocationIsMediumDistanceToGame: 2,
gameScoreLocationIsShortDistanceToGame: 5,
gameScoringHistoryIsVeryBad: −5,
gameScoringHistoryIsBad: −3,
gameScoringHistoryIsGood: 1,
gameScoringHistoryIsVeryGood: 2,
gameScoringHistoryIsExceptional: 5,
otherGameScoreMergedWithThisOne: 3,
//- verifications
verifiedByMultipleTweets: 10,
verifiedByTweetWithHighParseGrade: 15,
verifiedByTweetWithLowParseGrade: 4,
userIsLowTrustLevel: 0,
userIsMediumTrustLevel: 0,
userIsHighTrustLevel: 0,
userIsRustyTrustLevel: 0, //- only happens when rusty submited a score without a tweet?
scoreCreatedFromTweet: 0,
invalidScoring: −5,
```

Sample code of regex schemas used by the tweet parser algorithm

```
=====
var regexSchemas=[{
//- Ranked -------
schema: /[firstTeamRank] [firstTeam] [winLoseVerb] [secondTeamRank] [secondTeam](?:[,.:-]|) [dualScore]/,
rank: 130,
}, {
//- teamA loses to teamB, 45-7
schema: /[firstTeam] [winLoseVerb] [secondTeam](?:[,.:-]|) [dual Score]/,
rank: 65,
}, {
schema: /[firstTeamRank] [firstTeam] [prevailVerb] [dual Score] [over] [secondTeamRank] [secondTeam]/,
rank: 150,
}, {
schema: /[firstTeam] [prevailVerb] [dualScore] [over] [secondTeam]/,
```

rank: 70,
}, {
schema: /[firstTeam] [prevailVerb] [dualScore] (?:to|) [secondTeam]/,
rank: 58,
}, {
schema: /[firstTeam] [makesIt] [dualScore] [secondTeam]/,
rank: 54,
}, {
schema: /[firstTeam] [dualScore] [over] [secondTeam]/,
rank: 52,
}, {
schema: /[dualScore] [firstTeam] [over] [secondTeam]/,
rank: 50,
}, From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention the following:

1. A method for collaborative scoring of a sporting event, the method comprising:

receiving a plurality of digital communications at a verification server, each of the plurality of generic digital communications comprising content for a sporting event;

determining if each of the plurality of generic digital communications comprises content related to a specific real-time sporting event by parsing a text of each of the digital communications, wherein the content comprises at least one of which teams are playing, segment, scores, a game clock, game statistics, player statistics, a sport, a gender and a level of play;

determining a reputation of the originator of each of the plurality of digital communications;

determining a transmission time period for each of the plurality of digital communications;

determining an origination location of each of the plurality of digital communications and a distance of the origination location from the geographical location of the specific real-time event;

generating a confidence level using statistical analysis for each of the plurality of digital communications wherein the statistical analysis reviews all scores of the game, the type of sport, a segment, and a duration into the game, and the statistical analysis is based on a plurality of previous statistics computed from a plurality of past games;

determining the real-time score for the specific real-time sporting event based on a collaboration of verified content from the plurality of digital communications verified at the verification server for transmission time, origination location, reputation of the originator and the confidence level for each of the plurality of digital communications; and posting the real-time score for the specific real-time sporting event;

wherein the relation of each of the plurality of generic digital communications to the specific real-time sporting event is unknown until each of the plurality of generic digital communications is parsed.

2. The method according to claim 1 wherein the real-time score for the real-time sporting event is posted at a web site.

3. The method according to claim 1 wherein the specific real-time sporting event is one of a high school football game, a high school basketball game, a high school baseball game, a high school soccer game, a college football game, a college basketball game, a college baseball game, a college soccer game, a professional football game, a professional basketball game, a professional baseball game, a professional soccer game, a semi-professional football game, and a youth football game.

4. The method according to claim 1 further comprising subjecting each score to a machine learning model generated from a plurality of past confirmed scores, wherein a predicted result for each score is generated from a machine learning algorithm to generate a confidence level for each score.

5. The method according to claim 4 further comprising presenting all of the scoring for a game to the users for that game and allowing the users to vote on the accuracy of the entered score to generate a plurality of score assessments, wherein after each score assessment of the plurality of score assessment is generated, user information is utilized to determine a confidence level of an entered score, wherein user information comprises at least one of a user location, a user scoring history and a user level.

6. The method according to claim 1 wherein each of the plurality of digital communications is a communication from a mobile application resident on a mobile communication device.

7. The method according to claim 1 wherein each of the plurality of digital communications is a post on a social media site.

8. A system for allowing multiple users or sources to collaborate on real-time scoring for a specific real-time sporting event, the system comprising:

a verification server;

a plurality of sources of content for a specific real-time sporting event;

wherein the verification server is configured to receive a plurality of generic digital communications from the plurality of sources, each of the plurality of generic digital communications comprising content for a sporting event;

wherein the verification server is configured to determine if each of the plurality of generic digital communications comprises content related to a specific real-time sporting event by parsing a text of each of the generic digital communications, wherein the content comprises at least one of which teams are playing, segment, scores, a game clock, game statistics, player statistics, a sport, a gender and a level of play;

wherein the verification server is configured to determine a reputation of the originator of each of the plurality of generic digital communications;

wherein the verification server is configured to determine a transmission time period for each of the plurality of generic digital communications;

wherein the verification server is configured to determine an origination location of each of the plurality of generic digital communications and a distance of the origination location from the geographical location of the specific real-time event;

wherein the verification server is configured to generate a confidence level using statistical analysis for each of the plurality of generic digital communications wherein the statistical analysis reviews all scores of the game, the type of sport, a segment, and a duration into the game, and the statistical analysis is based on a plurality of previous statistics computed from a plurality of past games;

wherein the verification server is configured to determine the real-time score for the specific real-time sporting event based on a collaboration of verified content from the plurality of generic digital communications verified for transmission time, origination location, reputation of the originator and the confidence level for each of the plurality of generic digital communications; and wherein the verification server is configured to post the real-time score for the specific real-time sporting event;

wherein the relation of each of the plurality of generic digital communications to the specific real-time sporting event is unknown until each of the plurality of generic digital communications is parsed.

9. The system according to claim 8 wherein the real-time score for the real-time sporting event is posted at a web site.

10. The system according to claim 8 wherein the specific real-time sporting event is one of a high school football game, a high school basketball game, a high school baseball game, a high school soccer game, a college football game, a college basketball game, a college baseball game, a college soccer game, a professional football game, a professional basketball game, a professional baseball game, and a profession soccer game.

11. A method for collaborative scoring of a specific real-time sporting event, the method comprising:

receiving a plurality of generic digital communications from a plurality of sources at a verification server, each of the plurality of communications comprising content for a specific real-time sporting event;

determining if each of the plurality of generic digital communications comprises content related to the specific real-time sporting event by parsing a text of each of the plurality of generic digital communications, wherein the content comprises at least one of which teams are playing, segment, scores, a game clock, game statistics, player statistics, a sport, a gender and a level of play;

determining a origination location of each of the plurality of generic digital communications and a distance of the origination location from the geographical location of the specific real-time sporting event determining a reputation of the originator of each of the plurality of generic digital communications;

determining a transmission time period for each of the plurality of generic digital communications;

generating a confidence level for each of the plurality of generic digital communications based on at least one of a history of previous digital communications, an accuracy of previous digital communications, and a contribution type of previous digital communications determining the real-time score for the specific real-time sporting event based on a collaboration of verified content from the plurality of generic digital communications; and posting the real-time score for the specific real-time sporting event;

wherein the relation of each of the plurality of generic digital communications to the specific real-time sporting event is unknown until each of the plurality of generic digital communications is parsed.

* * * * *